United States Patent [19]

Meiser et al.

[11] Patent Number: 4,682,009

[45] Date of Patent: Jul. 21, 1987

[54] WALL MOUNTED COMBINED RADIACTIVE-CONVECTIVE ELECTRIC SPACE HEATER

[75] Inventors: Roland Meiser, Ehningen; Josef Burkert; Ralf Bendel, both of Bad Mergentheim, all of Fed. Rep. of Germany

[73] Assignees: Thermotechnik G. Bauknecht GmbH, Fellbach; Reinhold Barlian, Bad Mergentheim, both of Fed. Rep. of Germany

[21] Appl. No.: 743,513

[22] Filed: Jun. 11, 1985

[51] Int. Cl.[4] ..... F24H 3/00; H05B 3/00

[52] U.S. Cl. ..... 219/377; 219/345; 219/367; 219/374; 219/375

[58] Field of Search ..... 219/358, 364–368, 219/374–377, 381, 382, 342, 345

[56] References Cited

U.S. PATENT DOCUMENTS

| | | | |
|---|---|---|---|
| 568,168 | 9/1896 | Noyes | 219/366 |
| 2,230,095 | 1/1941 | Van Daam | 219/375 X |
| 2,939,807 | 6/1960 | Needham | 219/345 X |
| 2,978,568 | 4/1961 | Murphy | 219/374 X |
| 3,108,170 | 10/1963 | Murphy | 219/345 X |
| 3,356,829 | 12/1967 | Brandenburg | 219/377 X |
| 3,829,656 | 8/1974 | Temrin | 219/367 |
| 4,392,048 | 7/1983 | Carter | 219/367 |

FOREIGN PATENT DOCUMENTS

| | | | |
|---|---|---|---|
| 945583 | 1/1956 | Fed. Rep. of Germany . | |
| 424440 | 2/1935 | United Kingdom | 219/366 |

*Primary Examiner*—Anthony Bartis
*Attorney, Agent, or Firm*—Walter Ottesen

[57] ABSTRACT

A wall mounted space heater includes a housing having front and rear walls cojointly defining a space therebetween divided into a pair of convective air channels by a substantially vertically disposed solid flat metal plate having a first side facing the rear wall and a second side facing the front wall. The first side of the plate is coated with a layer of plastic in which is embedded an electric resistance heating element for heating the air flowing through the convective channels from air inlet openings formed in the housing bottom and lower portion of the front wall to air outlet openings formed in the upper portion of the front wall. The second side of the plate radiates heat toward the front wall and the metal plate is so disposed that some of the radiated heat passes through the openings in the upper and lower portions of the front wall directly into the room to be heated.

13 Claims, 6 Drawing Figures

WALL MOUNTED COMBINED RADIACTIVE-CONVECTIVE ELECTRIC SPACE HEATER

FIELD OF THE INVENTION

The invention relates to a space heater having at least one electrical heat resistance element such as a resistance hot wire. The heat resistance element is mounted in a housing having lower air inlets and upper air outlets and is positioned in spaced relationship to the front and rear walls of the heater.

BACKGROUND OF THE INVENTION

German Pat. No. 945,583 discloses a space heater of the above-mentioned type having a vertically arranged grid-like heating body mounted in a shielding housing having walls which at least partially include a mesh-like grid. In this space heater, the fresh air reaches the interior of the housing through the mesh-like grid whereby the air is swirled by the mesh-like grid so that the air can better take up the heat radiated by the hot wires. In the housing, the air passes through the grid-like heating body, moves upwardly on the rearward side of the heating body and is projected outwardly to the ambient from an upper grid in a jet-like manner.

However, the space heater disclosed in the above mentioned German Patent cannot be utilized in damp rooms such as a bathroom, shower room or the like. As a space heater, the apparatus has a large discharge because of the way it must be configured to provide the required contact safety. The fresh air flowing into the apparatus is swirled simultaneously from all sides such that the heated air does not flow outwardly therefrom in a directed and quieted flow. The apparatus therefore requires that free air can enter at all sides so that the apparatus cannot be mounted on a wall or utilized as a wall unit without modification.

U.S. Pat. No. 3,829,656 discloses a space heater wherein the heating elements are defined by horizontal heating rods which are arranged one above the other and are mounted in a closed housing. This housing is surrounded by an outer open housing into which fresh air flows from below. After warming, the air flows out through an upper outlet opening. Because of the arrangement of two metal housings, one disposed inside the other, substantial construction costs are incurred. Further, the heating elements do not directly warm the air because of their arrangement inside of a closed housing so that a long heating time is required.

A low pressure temperature heating apparatus is known having a flat frame-like housing which is made from formed pieces of enamelled sheet metal. The heating apparatus functions pursuant to the principal of a free standing heating wall which has neither air entry openings nor air exit openings. The heating apparatus functions in a manner such that the surrounding air reaches all sides of this heating wall in the same manner. For this purpose, the surface of the heating apparatus is of a raster-like construction by means of which an aimed direction of flow of the air flowing upwardly from below is prevented directly in the region of the heating elements. This apparatus is unsuitable for placement in rooms wherein sprayed water can impinge directly thereon because the heating wires are only surrounded with glass fibers.

SUMMARY OF THE INVENTION

It is an object of the invention to provide a heating apparatus of the above-mentioned type which requires fewer components and meets all safety requirements such as contact safety, protection against sprayed water and the like. It is a further object of the invention to provide such an apparatus wherein optimal heat output by means of convection as well as by means of radiation is provided in the presence of electrical heating elements having a low surface temperature.

The heating apparatus according to the invention has a simple configuration incorporating an air conducting channel wherein the air flowing into this channel from below is heated as a consequence of direct contact with heating elements embedded in a synthetic material on an air guiding conducting wall. By utilizing the chimney effect, the heated air is conducted upwardly to the outlet openings. The heating apparatus of the invention includes a further air conducting channel located on the side of the conducting wall facing away from this convection channel and is disposed between the front wall of the housing and the metal side of the conducting wall containing the surface heating elements. In this further channel which lies approximately parallel to the convection air channel, the air flowing therethrough is heated primarily by means of heat radiation; however, the air in this further channel is also heated by convection because of the upwardly directed flow. In the further channel, the uncoated side of the metal plate receives heat directly by heat conduction from the surface heating elements mounted on the other side of this metal plate. This metal plate delivers its heat by radiation to the metal front wall so that the front wall likewise contributes to heating the upwardly flowing air as well as delivering radiated heat to the room to be heated by the heating apparatus.

The configuration of a plastic layer on the metal conducting wall which is preferably made of aluminum and the embedment of the electrical resistance heating elements in the plastic layer make it possible that this conducting wall serving as a heating plate defines a low temperature surface heater. The surface heater can for example be driven by 400 to 600 watts if the space heater apparatus is configured as a wall convector. The conducting wall is heated quickly and uniformly because the electric energy is distributed over the entire surface of the air conducting plate as a consequence of the embedment of the electrical resistance wires or etched resistance paths. Accordingly, the air of the room flowing through the convection channel is likewise heated and at the same time, with the support and action of the metal plate, a portion of the developed heat energy is given off as radiation heat. This is applicable even if the side of the metal plate on which the electrically insulated heat element or elements are provided is covered with an additional metal plate.

In the convection channel, the chimney effect can be increased by placing the conducting wall at a slight angle with respect to the vertical. For example, the conducting wall can be positioned in such a manner that the convection channel tapers upwardly. Or, the conducting wall can be inclined in such a manner that the convection channel widens in the upward direction as will be shown below with reference to a preferred embodiment of the invention. In this way, the air is compelled to remain in the channel longer so that a more intense heating thereof in the lower region of the channel is obtained.

BRIEF DESCRIPTION OF THE DRAWING

The invention will now be described with reference to the drawing wherein.

DESCRIPTION OF THE PREFERRED EMBODIMENTS OF THE INVENTION

Figure 1:
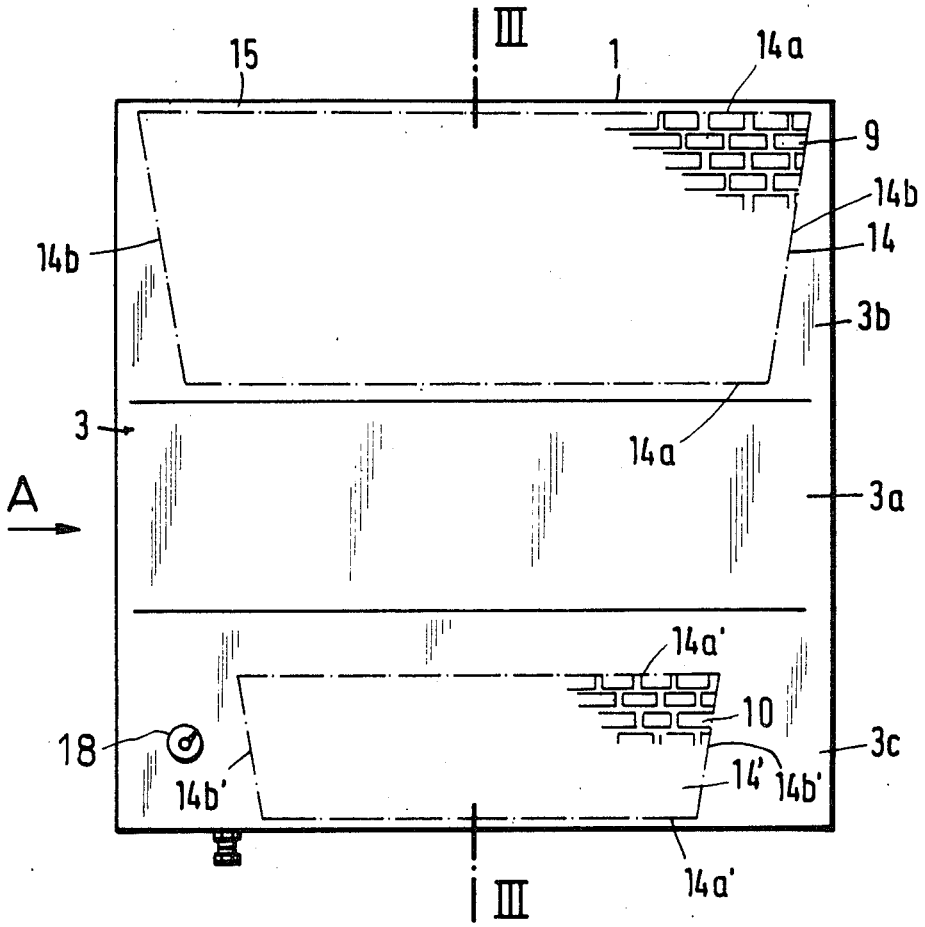
FIG. 1 is a front elevation view of the space heating apparatus of the invention configured as a wall heater.

The space heating apparatus shown in the drawing is configured as a wall heater and is especially suited for heating smaller rooms such as a bathroom, powder room, lavatory or the like. The wall heater has a housing 1 which includes a rear wall 2 and a front wall 3. A conducting wall 4 is disposed between the two walls 2 and 3 and is mounted so as to be in an approximately vertical position.

Figure 6:
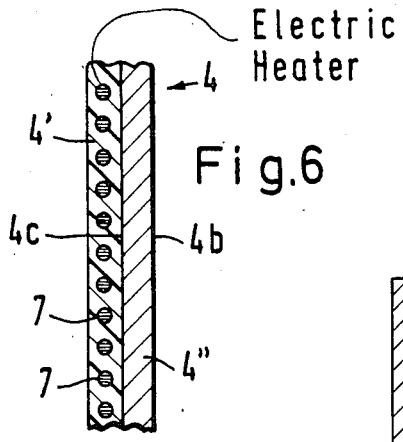
FIG. 6 is a sectional view of a portion of the conducting wall at the location VI of FIG. 3.
Figure 2:
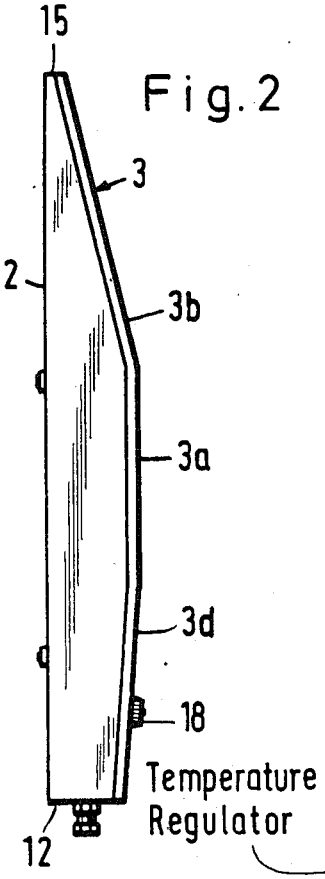
FIG. 2 is a side elevation view taken inthe direction of arrow A of FIG. 1.
Figure 3:
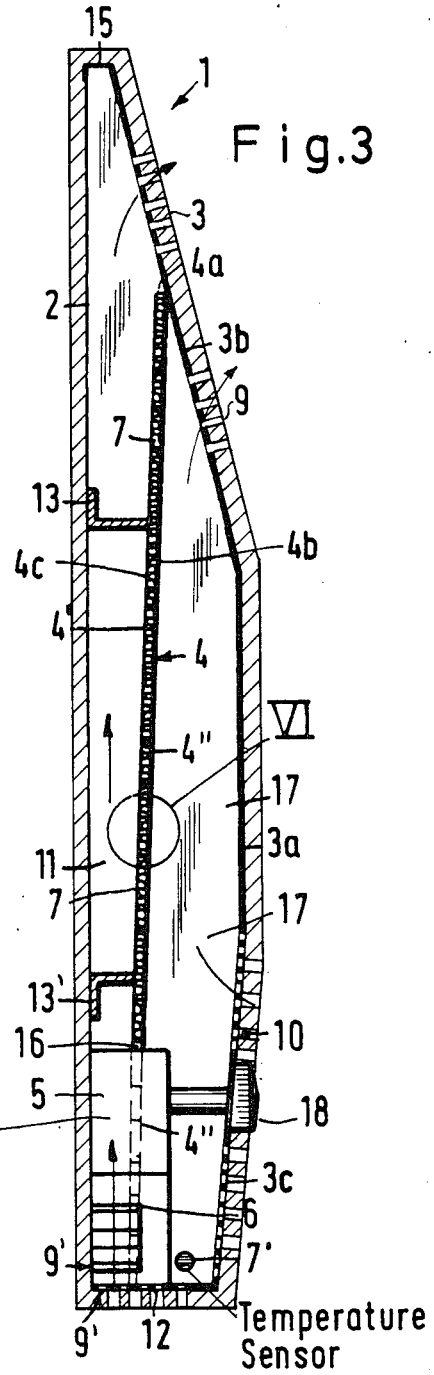
FIG. 3 is a section view taken along line III—III of FIG. 1.
Figure 4:
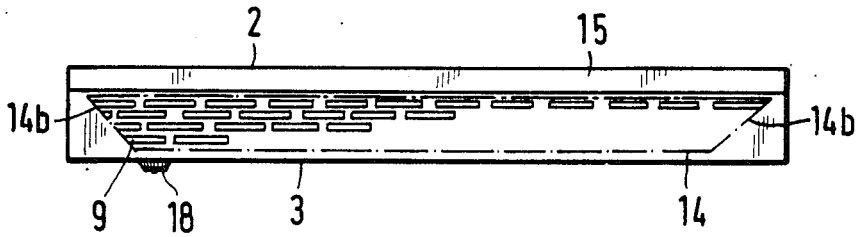
FIG. 4 is a top plan view of the wall heater of FIG. 1.
Figure 5:
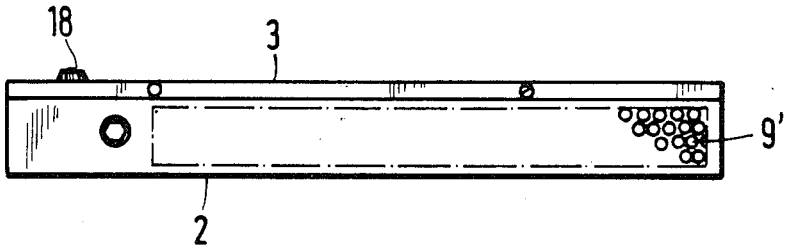
FIG. 5 is a view from below of the wall heater of FIG. 1.

As shown in the enlarged view of FIG. 6, the conducting wall 4 is made of a metal plate 4'' on which an electrically insulated layer 4' of plastic is applied and into whichthe actual heating element 7 is embedded. This coated side **4*c* of the metal plate 4'' and the rear wall 2 conjointly define a convection channel 11. The conducting wall 4 extends down to the base 12 whereat it is seated and extends upwardly to the upper part of the apparatus. Accordingly, air can enter the apparatus through air inlet openings 9' located in the base 12 and/or in the lower region in the rear wall 2 and, as a consequence of the air being heated by the heating element 7 on the metal plate 4', the air flows in the convection channel 11 in the direction of the (FIG. 3) all the way up and into the upper part of the apparatus where it exits as warmed air. The conducting wall 4 is advantageously positioned so that the plane defined by this wall forms a small acute angle with the vertical plane. Specifically, the conducting wall 4 is inclined with respect to the rear wall 2 as shown in FIG. 3 in order to favor the natural chimney action of the flow of air which flows upwardly. In FIG. 3, the inclined position in the upward direction is divergent. The conducting wall 4 can also be advantageously mounted so that it is inclined against the rear wall in such a manner that the reduced channel formed thereby in the upper region of the convection channel 11** leads to a slight increase in the speed of the air exiting from the apparatus.

The heating element 7 is provided on the entire surface facing toward the convection channel 11 so that the most possible uniform, quick and intensive heating of the air rising in the convection channel 11 is obtained. The conducting wall 4 is made of a thin metal plate 4'' having a thickness of between 0.5 to 5 mm and is preferably 1.5 mm thick. The metal plate 4'' is preferably made of aluminum. The metal plate 4'' is a good conductor of heat and is provided with a plastic layer 4' on one side thereof, preferably, the side facing toward the rear wall 2 of the apparatus. The layer of plastic is very thin and can be made a silicone layer having a thickness of 0.8 to 2.5 mm. This plastic layer both covers and insulates the heating element 7 mounted so as to be distributed uniformly over the entire surface of the conducting wall 4 on the one side thereof as, for example, in the manner of an electric resistance wire or an etched resistance path.

The conducting wall 4 therefore has a surface heating element which heats practically the entire coated side **4*c* of the metal plate 4'' and delivers this heat through the thin plastic layer 4' directly by mcans of convection to thc room air flowing upwardly in channel 11**.

The other surface **4*b* of the metal plate 4'' of the conducting wall 4 which is not coated is directly heated by the heating element 7 in the layer 4'. The surface 4*b* delivers a substantial part of the heat taken up as radiated heat to the forward wall 3 which is likewise made of metal and which becomes heated thereby and can radiate heat outwardly. Since the conducting wall 4 is in spaced relationship to the front wall 3, the enclosed radiation space 17 forms an additional heating channel which functions pursuant to the chimney effect. An optimal natural flow of the air through air inlet openings 10 and air outlet openings 9 is obtained when the air flowing upwardly through the space 17 is, in addition, heated convectively as a consequence of its contact with the heated metal plate 4''**.

An optimal utilization of the electrically heated conducting wall 4 by means of convective heat emittance as well as by means of heat radiation to the space 17, it is further provided that the conducting wall 4 is extended up into the upper quarter of the apparatus so that its upper edge **4*a* is approximately flush with the upper portion 3*b* of the cover 3. The conducting wall 4 is mounted to the rear wall by means of struts 13, 13'. The mid portion 3*a* of the forward wall 3 is mounted to be parallel to or at least approximately parallel to the rear wall 2 or to the metal plate 4''. The upper portion 3*b* inclined with respect to the rear wall 2 extends above this center portion 3*a* and causes the free space located between the rear wall 2 and the wall 3 to be tapered in the direction of the upper housing edge 15. In this diagonally extending upper portion 3*b*, a raster-like field of openings 9 one next to the other is provided through which the convectively heated air in space 17 can exit. Since the raster-like field of opening 9 takes in the entire elevation of the inclined upper portion 3*b* and the metal plate 4'' extends up to approximately beyond the center of this inclined front wall upper portion 3*b* as shown in FIG. 3, radiated heat of the surface 4*b* of the plate 4'' behind the openings 9 can at the same time pass through the latter and into the room to be heated. Accordingly, a maximum heat output directly into the room to be heated is obtained. This maximum output of heat is made possible by the heat radiating surface 4*b* of the metal plate 4'' in the forward region of the apparatus and the arrangement of the air channel 17 as well as the upper outlet openings 9 and the lower inlet openings 10. Because of the inclination of the upper portion 3*b* of the forward wall, the chimney effect of the entering air of the room is at the same time increased in the channel 17**.

The lower portion **3*c* of the front wall 3 can be configured so that it extends slightly inclined with respect to the rear wall 2 of the housing in such a manner that the air can enter the openings 10 unobstructed and immediately flow upwardly into the radiation space 17. The inlet openings 10 are also arranged in a raster-like field 14' and are formed in portion 3c as shown in FIG. 1**.

In order to establish optimal inlet and outlet conditions for the air, not only are the raster-like fields 14, 14' to be made optimally large so that they each take up the largest part of the respective wall portions 3b and 3c, but also they are geometrically configured so that their longitudinal sides 14a, 14a' extend parallel to each other; whereas, the lateral edges 14b, 14b' are arranged to diverge outwardly in the direction of the upwardly flowing air. With this configuration, the air pass-through opening in the direction of the upwardly flowing air becomes larger so that an improved outflow of the heated air is obtained especially at the widening upper raster-like field 14 in the upper portion of the radiation space 17 which narrows in the upward direction.

It is essential that center or mid portion 3a of the forward wall 3 has no air outlet openings in order to provide a favorable conduction of the air in the space 17 and for an optimal utilization of the radiated heat with a simultaneous convective heat delivery to the air located in the space 17.

In the heating apparatus of the invention for heating small rooms, the conducting wall 4 is mounted at a defined spacing from the rear wall 2 of the housing 1. With this positioning of the conducting wall 4, a precisely determined disposition is obtained for the heat radiation surface 4b of the metal plate 4'' to the forward wall 3 and to the pass-through openings 9 and 10 provided in the forward wall 3.

In a further embodiment of the heating apparatus according to the invention, a temperature regulator 5 having adjusting knob 18 connecting terminals 6 is mounted in one of the corners of the housing 1 for which the conducting wall 4 has an opening 16 adapted to accommodate the parts 5 and 6. In this manner, the temperature regulator 5 and connecting terminals 6 are mounted in a part of the housing which facilitates assembly while at the same time causing the heat emitting behavior of the conducting plate 4 and the flow conditions in the channels 11 and 17 to remain unaffected.

In addition, at an appropriate location in the region of the air inlet openings 10, a temperature sensor 7' is provided which senses the temperature of the air flowing into the apparatus and detects the same at the forward side. The sensor 7' delivers the temperature to the temperature regulator 5 which then correspondingly controls the heating elements embedded in the plastic layer. With this embodiment of the invention, a flat heating apparatus is provided which preferably functions with a temperature of the heating elements of 220° C. and by means of which the surface temperature of the housing does not exceed the low temperature region so that the apparatus can be used in shower rooms, lavatories and the like without the danger of injury to persons as a consequence of coming into surface contact therewith. With the arrangement and configuration of the conducting plate 4 and the thin heating elements disposed thereon and embedded to lie flatly in an insulated layer, a special advantage is obtained in that an overheating of the apparatus is precluded since the maximum temperature of the electric heating elements cannot exceed 220° C. so that the entire apparatus operates as a low-temperature convector.

The room heating apparatus according to the invention meets all requirements with respect to protection against sprayed water so that the installation of the apparatus in damp rooms such as bath rooms is without danger and without the necessity of making any modifications. In contrast to known small heating apparatus of this kind, the apparatus of the invention operates without a fan and is therefore fully without sound whereby the air heated through convection is likewise not heated higher than to a temperature of 60° to 70° C. The apparatus of the invention can be fitted with an automatic control for controlling the temperature of a room whereby a rapid heating of the room results because of the special configuration of the air conducting channels and the chimney effect obtained thereby. The latter is not only a significant advantage achieved with the configuration of the thin heated conducting plate, it also makes the especially flat configuration of the apparatus possible by means of which an optimal electrical heating apparatus can be provided to accommodate the most narrow spatial conditions.

The low thermal load of the apparatus components ensures a long operational life of the apparatus. With the arrangement of the temperature sensor 7'0 in the inflow region or in the air inflow channel 17, the sensor 7' can function accurately because it lies beyond the effective radiation region of the metal plate 4'' which has only a maximum temperature of approximately 220° C. so that an unfavorable influence of the control accuracy of the sensor 7' is not a problem. The heating apparatus according to the invention operates at low temperatures of the heating body of approximately 220° C. and, as a consequence of the high convective heat delivery achieves a pleasant climate in the room which is free from burned dust particles and is without a forced recirculation of the air and therefore is not a problem with respect to noise.

The conducting wall can also be made of two plates of good heat conducting metal such as aluminum which are cemented to each other or are connected to each other in some other manner. One or more electrical heating elements are disposed between these two metal plates and the heating elements can be in the form of one or more resistance hot wires, for example, which are electrically insulated with respect to the metal plates and distributed thereon so as to be substantially in a plane so that the metal plates can be uniformly heated over their entire surfaces.

It is understood that the foregoing description is that of the preferred embodiments of the invention and that various changes and modifications may be made thereto without departing from the spirit and scope of the invention as defined in the appended claims.

What is claimed is:

1. A space heating apparatus for mounting on a wall surface of a room to be heated, the apparatus comprising:

a housing including a substantially flat rear wall adapted for mounting to the wall surface, and a front wall adjacent said rear wall, said front wall and said rear wall conjointly defining a space therebetween through which the air to be heated passes, said front wall having a lower portion extending upwardly from the bottom of said housing a solid uninterrupted mid portion devoid of any openings and an upper portion extending upwardly from said mid portion to the top of said housing;

an inlet means at the lower end of said housing for admitting and directing the air into said space;

air outlet means at the upper end of said housing whereat the heated air leaves said space and passes from said housing;

a solid, uninterrupted metal plate having a first flat side and a second flat side;

an electrically insulating plastic layer formed only on said first flat side of said metal plate so as to leave said second side as an uncovered and exposed metal surface;

said metal plate being mounted in said space so as to partition said space into two convecting channels and having an upper portion extending above said mid portion of said front wall;

said plastic layer and said rear wall conjointly defining one of said convecting channels for communicating with a portion of said air outlet means and for conducting a portion of the incoming air admitted to said space as it moves upwardly to said portion of said air outlet means;

said second flat side and said front wall with said solid uniterrupted mid portion conjointly defining the other one of said convecting channels for communicating with the reminder of said air outlet means and for conducting the remainder of the incoming air admitted to said space as it moves upwardly to said remainder of said air outlet means;

resistance heating means embedded in and throughout said plastic layer for heating the air rising in both of said convecting channels and for radiating heat from said second flat side of said plate; and, said remainder of said outlet means being formed in the upper portion of said front wall so as to be disposed laterally of said upper portion of said metal plate thereby permitting at least a portion of the heat radiated from said second flat side of said metal plate to pass therethrough directly into the room to be heated.

2. The space heating apparatus of claim 1, said metal plate being inclined with respect to said rear wall by 1° to 3°.

3. The space heating apparatus of claim 2, said metal plate having a thickness of between 0.5 to 3 mm and insulating plastic layer having a thickness of between 0.8 to 2.5 mm.

4. The space heating apparatus of claim 1, said mid portion being approximately parallel to said rear wall and said upper portion of said front wall being inclined toward said rear wall so as to cause said space, to taper and have a cross-section that becomes increasingly narrower with increased upward distance from said mid portion.

5. The space heating apparatus of claim 4, said lower portion being inclined toward said rear wall so as to cause said space to taper and have a cross-section that becomes increasingly narrower with increased downward distance from said mid portion.

6. The space heating apparatus of claim 5, said housing having a bottom wall, said air inlet means being a plurality of inlet openings arranged in a raster-like pattern and being formed in at least one of sid bottom wall and said lower portion of said front wall.

7. The space heating apparatus of claim 6, said first portion of said air outlet means being a first plurality of outlet openings and said remainder of said air outlet means being a second plurality of outlet openings, said first and second pluralities of outlet openings being arranged in a raster-like pattern and being formed in said upper portion of said front wall.

8. The space heating apparatus of claim 7, said metal plate and said plastic layer formed thereon conjointly defining a conducting wall; said conducting wall extending downwardly to said bottom wall and extending upwardly to said outlet openings so as to partition the same into said first and second pluralites of outlet openings.

9. The space heating apparatus of claim 7, each of said raster-like fields having lateral sides diverging outwardly in the upward direction so as to cause the total cross-section of said openings to increase in said upward direction.

10. The space heating apparatus of claim 1, said housing including a bottom wall between the respective lower edges of said rear wall and said front wall, a left side wall joining the respective left lateral edges of said front wall and rear wall, and a right side wall joining the respective right lateral edges of said front wall and said rear wall, one of said side walls, said bottom wall and said rear wall conjointly defining a lower corner of said housing, the apparatus further comprising a temperature regulator having connecting terminal and being mounted in said corner, and said metal plate having an opening formed therein adapted to accommodate said temperature regulator.

11. The space heating apparatus of claim 10, comprising a temperature sensor mounted on said second side of said metal plate in the vicinity of said air inlet means.

12. A space heating apparatus for mounting on a wall surface of a room to be heated, the apparatus comprising:

a housing including a substantially flat rear wall adapted for mounting to the wall surface and a front wall adjacent said rear wall, said front wall and said rear wall conjointly defining a space therebetween through which the air to be heated passes;

a solid metal plate having a first flat side and a second flat side;

an electrically insulating plastic layer formed only on said first flat side of said metal plate so as to leave said second flat side as an uncovered and exposed metal surface;

said metal plate being mounted in said space so as to partition said space into two convecting channels;

said plastic layer and said rear wall conjointly defining one of said convecting channels and said metal surfaces and said from wall conjointly defining the other one of said convecting channels;

air inlet means at the lower end of said housing for admitting air from the room into said convecting channels;

said front wall having an upper portion inclined toward said rear wall so as to cause said to taper and have a cross section that becomes increasingly narrower with decreasing distance from the top of said housing;

a plurality of air outlet openings formed in said upper portion for passing heated air from said channels to the room;

said plate and said layer conjointly defining a conducting wall extending upwardly in said housing to said upper portion so as to partition said plurality of openings into a first group of openings communicating with said one convecting channel and a second group of openings communicating with said other one of said convecting channels and being disposed laterally of said second flat side; and, resistance heating means embedded in and throughout said plastic layer for heating the air rising in both of said channels and for radiating heat from said second flat side of said plate directly through said second group of openings and into said room.

13. A space heating apparatus for mounting on a wall surface of a room to be heated, the apparatus comprising:

a housing including a substantially flat rear wall adapted for mounting to said wall surface and a front wall adjacent said rear wall, said front wall and said rear wall cpnjointly defining a space therebetween through which the air to be heated passes;

a solid metal plate having a first flat side and a second flat side;

distributed resistance means arranged only on said first flat side of said metal plate so as to leave said second flat side as an uncovered and exposed metal surface;

said metal plate being mounted in said space so as to partition said into two convecting channels;

said distributed resistance means and said rear wall conjointly defining one of said convecting channels and said metal surface and said front wall conjointly defining the other one of said convecting channels;

said front wall being subdivided into a lower portion, a mid portion and an upper portion, said mid portion being devoid of air outlet openings and being approximately parallel to said rear wall, said upper portion being inclined toward said rear wall so as to cause said space to taper and have a cross section that becomes increasingly narrower with increased upward distance from said mid portion, and said lower portion being inclined toward said rear wall so as to cause said space to taper and have a cross section that becomes increasingly narrower with increased downward distance from said mid portion;

air inlet means at the lower end of said housing for admitting air from the room into said connecting channels, said air inlet means including a plurality of air inlet openings formed in said lower portion of said front wall so as to lie opposite said second flat side of said metal palte;

a first plurality of air outlet openings formed in a first region of mid upper portion so as to communicate with said one convection channel for passing convected air therefrom to the room;

a second plurality of air outlet openings formed in a second region of said upper portion so as to lie opposite said second flat side and so as to communicate with said other one of said convecting channels for passing convected air therefrom to the room; and, said distributed resistance means being distributed substantially evenly over said first flat side for heating the air rising in both of said channels and for radiating heat from said second flat side of said metal plate directly through said plurality of air inlet openings and into the room and directly through said second plurality of air outlet openings also directly into the room. CCC

* * * * *

UNITED STATES PATENT AND TRADEMARK OFFICE

CERTIFICATE OF CORRECTION

PATENT NO. : 4,682,009

DATED : July 21, 1987

INVENTOR(S) : Roland Meiser et al

It is certified that error appears in the above-identified patent and that said Letters Patent is hereby corrected as shown below:

In column 3, line 9: delete "inthe" and substitute -- in the -- therefor.

In column 3, line 33: delete "whichthe" and substitute -- which the -- therefor.

In column 3, line 43: after the word "the" second occurrence, add -- arrows --.

In column 4, line 1: after the word "made", add the word -- of --.

In column 4, line 11: delete "mcans" and substitute -- means -- therefor.

UNITED STATES PATENT AND TRADEMARK OFFICE

CERTIFICATE OF CORRECTION

PATENT NO. : 4,682,009

DATED : July 21, 1987

INVENTOR(S) : Roland Meiser et al

It is certified that error appears in the above-identified patent and that said Letters Patent is hereby corrected as shown below:

In column 4, line 12: delete "thc" and substitute -- the -- therefor.

In column 4, line 28: delete "An" and substitute -- In order to achieve an -- therefor.

In column 4, line 47: delete "opening 9" and substitute -- openings 9 -- therefor.

In column 5, line 34: add -- and -- after the word "knob 18".

In column 6, line 22: delete "sensor 7'0" and substitute -- sensor 7' -- therefor.

UNITED STATES PATENT AND TRADEMARK OFFICE

CERTIFICATE OF CORRECTION

PATENT NO. : 4,682,009

DATED : July 21, 1987

INVENTOR(S) : Roland Meiser et al

It is certified that error appears in the above-identified patent and that said Letters Patent is hereby corrected as shown below:

In column 6, line 63: add a comma after the word "housing".

In column 6, line 67: delete "an" and substitute -- air -- therefor.

In column 7, line 21: delete "uniterrupted" and substitute -- uninterrrupted -- therefor.

In column 7, line 23: delete "reminder" and substitute -- remainder -- therefor.

In column 7, line 42: after the word "and", add -- said --.

In column 7, line 48: delete the comma after the word "space" .

UNITED STATES PATENT AND TRADEMARK OFFICE

CERTIFICATE OF CORRECTION

PATENT NO. : 4,682,009

DATED : July 21, 1987

INVENTOR(S) : Roland Meiser et al

It is certified that error appears in the above-identified patent and that said Letters Patent is hereby corrected as shown below:

In column 7, line 60: delete "sid" and substitute -- said -- therefor.

In column 8, line 6: delete "pluralites" and substitute -- pluralities -- therefor.

In column 8, line 22: delete "terminal" and substitute -- terminals -- therefor.

In column 8, line 48: delete "surfaces" and substitute -- surface -- therefor.

In column 8, line 48: delete "from" and substitute -- front -- therefor.

UNITED STATES PATENT AND TRADEMARK OFFICE

CERTIFICATE OF CORRECTION

PATENT NO. : 4,682,009

DATED : July 21, 1987

INVENTOR(S) : Roland Meiser et al

It is certified that error appears in the above-identified patent and that said Letters Patent is hereby corrected as shown below:

In column 8, line 54: after the word "said" second occurrence, add the word -- space --.

In column 9, line 12: delete "cpnjointly" and substitute -- conjointly -- therefor.

In column 9, line 21: after the word "said", add the word -- space --.

In column 10, line 9: delete "connecting" and substitute -- convecting -- therefor.

In column 10, line 13: delete "palte;" and substitute -- plate; -- therefor.

UNITED STATES PATENT AND TRADEMARK OFFICE

CERTIFICATE OF CORRECTION

PATENT NO. : 4,682,009

DATED : July 21, 1987

INVENTOR(S) : Roland Meiser et al

It is certified that error appears in the above-identified patent and that said Letters Patent is hereby corrected as shown below:

In column 10, line 15: delete "mid" and substitute -- said -- therefor.

In column 10, line 31: delete "CCC".

Signed and Sealed this

Ninth Day of February, 1988

*Attest:*

DONALD J. QUIGG

*Attesting Officer*

*Commissioner of Patents and Trademarks*